US006034488A

United States Patent [19]

Lindauer et al.

[11] Patent Number: 6,034,488

[45] Date of Patent: Mar. 7, 2000

[54] ELECTRONIC BALLAST FOR FLUORESCENT LIGHTING SYSTEM INCLUDING A VOLTAGE MONITORING CIRCUIT

[75] Inventors: Louis F. Lindauer, Wilmington, Del.; Joseph Deschamp, Philadelphia, Pa.

[73] Assignee: Lighting Control, Inc., Aston, Pa.

[21] Appl. No.: 09/015,834

[22] Filed: Jan. 29, 1998

Related U.S. Application Data

[63] Continuation-in-part of application No. 08/657,993, Jun. 4, 1996, abandoned.

[51] Int. Cl.[7] ..... H05B 37/02

[52] U.S. Cl. ..... 315/247; 315/DIG. 7; 315/307; 315/244; 315/324

[58] Field of Search ..... 315/247, DIG. 4, 315/DIG. 7, 307, 291, 224, 244, 324

[56] References Cited

U.S. PATENT DOCUMENTS

| | | | |
|---|---|---|---|
| Re. 33,057 | 9/1989 | Clegg et al. | 315/224 |
| 3,263,122 | 7/1966 | Genuit | 315/DIG. 7 |
| 3,335,318 | 8/1967 | Yancey | 315/194 |
| 3,430,101 | 2/1969 | Biltz | 315/194 |
| 3,573,543 | 4/1971 | Grindstaff | 315/194 |
| 3,763,396 | 10/1973 | Shilling | 315/307 |
| 4,024,451 | 5/1977 | Nishino et al. | 321/2 |
| 4,042,855 | 8/1977 | Buenzli, Jr. | 315/219 |
| 4,060,752 | 11/1977 | Walker | 315/244 |
| 4,100,476 | 7/1978 | Ghiringhelli | 315/297 |
| 4,158,792 | 6/1979 | Kuroi et al. | 315/86 |
| 4,210,956 | 7/1980 | Watanabe | 363/51 |
| 4,220,895 | 9/1980 | Nuver | 315/195 |
| 4,277,278 | 7/1981 | Stevens . | |
| 4,277,726 | 7/1981 | Burke | 315/DIG. 7 |
| 4,328,454 | 5/1982 | Okuyama et al. | 318/803 |
| 4,335,318 | 6/1982 | Mabuchi et al. | 290/31 |
| 4,352,045 | 9/1982 | Widmayer | 315/205 |
| 4,370,600 | 1/1983 | Zansky | 315/244 |
| 4,392,087 | 7/1983 | Zansky | 315/219 |
| 4,478,468 | 10/1984 | Schoen et al. | 315/291 |
| 4,511,195 | 4/1985 | Barter | 315/308 |
| 4,523,128 | 6/1985 | Stamm et al. | 315/291 |
| 4,523,131 | 6/1985 | Zansky | 315/247 |
| 4,538,093 | 8/1985 | Melai | 315/DIG. 7 |
| 4,568,857 | 2/1986 | Head | 315/105 |
| 4,633,161 | 12/1986 | Callahan et al. | 315/242 |

(List continued on next page.)

FOREIGN PATENT DOCUMENTS

| | | |
|---|---|---|
| 390532 | 7/1987 | Germany . |
| 2045549 | 10/1980 | United Kingdom . |

OTHER PUBLICATIONS

"Electronic Ballasts Using the Cost–Saving IR215X Drivers", *Control Integrated Circuit Designers' Manual,* p. C–59–C–68.

*Primary Examiner*—Michael B Shingleton
*Attorney, Agent, or Firm*—Akin, Gump, Strauss, Hauer & Feld, L.L.P.

[57] ABSTRACT

A fluorescent lighting system connected to an AC voltage source providing a first AC voltage is disclosed. A converter circuit connected to the AC voltage source converts the first AC voltage to a DC voltage. An oscillator circuit receives the DC voltage and produces a second AC voltage. The oscillator circuit includes a series resonant circuit and a removable installed fluorescent lamp. The series resonant circuit includes a resonant capacitor and a resonant conductor in series. The lamp has first and second elements and is connected in parallel with the resonant capacitor of the series resonant circuit such that lighting current runs between the first and second elements. The second element is connected in series with the resonant capacitor and the resonant inductor and acts as a switching element. When the lamp is removed from the system, the absence of the switching element creates an open circuit between the resonant capacitor and the resonant inductor such that the oscillator circuit does not operate.

7 Claims, 5 Drawing Sheets

U.S. PATENT DOCUMENTS

| | | | |
|---|---|---|---|
| 4,642,525 | 2/1987 | Widmayer | 315/199 |
| 4,651,060 | 3/1987 | Clark | 315/199 |
| 4,677,345 | 6/1987 | Nilssen . | |
| 4,689,547 | 8/1987 | Rowen et al. | 315/239 |
| 4,700,113 | 10/1987 | Stupp et al. | 315/224 |
| 4,797,599 | 1/1989 | Ference et al. | 315/194 |
| 4,816,985 | 3/1989 | Tanahashi | 363/81 |
| 4,818,918 | 4/1989 | Murphy | 315/244 |
| 4,827,151 | 5/1989 | Okada | 307/66 |
| 4,843,246 | 6/1989 | Benes et al. | 250/491.1 |
| 4,904,906 | 2/1990 | Atherton et al. | 315/291 |
| 4,933,606 | 6/1990 | Tary | 315/244 |
| 4,937,505 | 6/1990 | Deglon et al. | 315/307 |
| 4,942,511 | 7/1990 | Lipo et al. | 363/136 |
| 4,954,768 | 9/1990 | Luchaco et al. | 323/300 |
| 4,965,509 | 10/1990 | Oldham | 323/300 |
| 5,004,957 | 4/1991 | Cunningham | 315/199 |
| 5,018,058 | 5/1991 | Ionescu et al. | 363/34 |
| 5,038,081 | 8/1991 | Maiale, Jr. et al. | 315/291 |
| 5,045,774 | 9/1991 | Bromberg . | |
| 5,055,742 | 10/1991 | Jurell et al. | 315/94 |
| 5,055,746 | 10/1991 | Hu et al. | 315/291 |
| 5,075,602 | 12/1991 | Overgoor et al. | 315/307 |
| 5,182,702 | 1/1993 | Hiramatsu . | |
| 5,187,414 | 2/1993 | Fellows et al. | 315/307 |
| 5,192,896 | 3/1993 | Qin | 315/224 |
| 5,225,741 | 7/1993 | Auld, Jr. et al. | 315/307 |
| 5,251,119 | 10/1993 | Maehara . | |
| 5,323,088 | 6/1994 | Cunningham | 315/195 |
| 5,363,020 | 11/1994 | Chen et al. | 315/209 R |
| 5,396,155 | 3/1995 | Bezdon et al. | 315/291 |
| 5,424,618 | 6/1995 | Bertenshaw et al. | 315/324 |
| 5,471,116 | 11/1995 | Schiller | 315/209 R |
| 5,500,575 | 3/1996 | Ionescu | 315/307 |
| 5,504,398 | 4/1996 | Rothenbuhler | 315/209 R |
| 5,539,281 | 7/1996 | Shackle et al. | 315/224 |
| 5,550,440 | 8/1996 | Allison et al. | 315/294 |
| 5,559,395 | 9/1996 | Venkitasubrahmanian et al. | 315/247 |
| 5,559,405 | 9/1996 | Otohamiprodjo . | |
| 5,608,295 | 3/1997 | Moisin . | |
| 5,714,847 | 2/1998 | Lindauer et al. | 315/307 |

ELECTRONIC BALLAST FOR FLUORESCENT LIGHTING SYSTEM INCLUDING A VOLTAGE MONITORING CIRCUIT

This is a continuation-in-part application of U.S. patent application Ser. No. 08/657,993, filed Jun. 4, 1996 now abandoned.

FIELD OF THE INVENTION

The present invention relates to power supply circuits for providing operating voltage and current to optoelectronic sources such as lamps. More specifically, the invention is directed to an electronic ballast for providing optimum power transfer and stable operating voltage to one or more parallel-connected fluorescent lamps.

BACKGROUND OF THE INVENTION

Mass-market electronic light sources or luminous devices come in three general types: tungsten-filament lamps, electric-discharge lamps and electroluminescent lamps, the most common of which being the electric-discharge type that includes fluorescent lamps, mercury lamps, metal halide lamps, and the like. These electric-discharge lamps range from very simple in design to the very complex depending upon their intended application, operating environment, power requirements and operating efficiency.

Fluorescent lamps of the "hot-cathode" type include three classes: preheat, instant-start, and rapid-start. The pre-heat lamp variety allows preheating of a cathode for a few seconds before striking an arc for generating ultraviolet radiative energy for initiating the fluorescent process. The instant-start lamp variety does not require preheating of a cathode but instead enables the application of a start voltage of sufficient magnitude between the lamp electrodes to strike the arc. The rapid-start lamp variety have a continuously heated cathode which requires a lower voltage than the instant-start lamps.

As fluorescent lamps present a variable or non-linear load impedance to a power supply sourcing the operating voltage and current depending upon the lamp operating modes, e.g., start-up and steady state, special circuitry is required in order to maximize power transfer efficiency while additionally providing some manner of protection of delicate lamp and power supply circuit components in the event of a short or open circuit condition. Most power supply circuits for fluorescent lamps will first convert line voltage, i.e., 120 Vac/60 Hz, to a dc voltage and then invert the d.c. voltage back into a stepped-up a.c. voltage at a higher frequency, e.g., 50 KHz, in order to provide a stable, steady state operating point for the particular lamp, and, that is particularly immune from noise. The manner in which to achieve a certain amount of protection for the lamp and power supply components is to provide a ballast element at the output of the power supply for limiting the lamp current to the required value for proper operation regardless of the instantaneous changes in the load impedance. In addition, the ballast must provide the required turn-on starting voltage and current for the fluorescent lamp. As an elementary example, an inductor or coil element connected between the power supply output and the input of the lamp terminal provides, in essence, a ballast by preventing instantaneous current changes which may harm sensitive lamp circuit components.

As known to skilled artisans, an inductor coil is the simplest form of ballast that is very inefficient from a power transfer standpoint, and largely not practical for use in most type of lamps. To remedy this problem, electronic ballasts have been designed for fluorescent lamps in conjunction with capacitive power factor correction circuitry in order to increase power transfer efficiency.

In fluorescent lighting systems of general industrial applications, there may be required a series or parallel connection of two or more lamps in order to provide sufficient luminous intensity for the given application. The most popular fluorescent lamp utilized in such systems are the rapid-start variety which requires the continuous application of a small voltage at the lamp terminals in order to keep the initial strike voltage lower upon turn-on. These parallel or series connections are usually sourced by 120 Vac/60 Hz line in series with a ballast. Series connected lamps provide an inconvenience whereby if one lamp burns out or should fail, the rest of the lamps will soon fail. Additionally, different ballast circuits are required depending upon the number of rapid-start lamps utilized in the particular fluorescent lighting system of a given application, i.e., like ballast circuits are provided with like systems having the same number of bulbs.

Currently, there exists the need for an electronic ballast circuit for a fluorescent lighting system that comprises one or more parallel-connected instant-start fluorescent lamps.

The need also exists for an electronic ballast for an instant-start fluorescent lighting system that is configurable to accommodate from one up to as many as four fluorescent lamp elements connected in parallel.

There is an additional need for an instant-start fluorescent lighting system that provides a ballast circuit that is adaptable and does not need to be replaced when lamps are removed, added, or replaced from the lighting system.

SUMMARY OF THE INVENTION

Accordingly, it is thus an object of the present invention to provide an electronic ballast for a fluorescent lighting system that includes one or more fluorescent lamps connected in parallel.

A more specific object of the present invention is to provide an electronic ballast for a fluorescent lighting system that includes one or more parallel-connected fluorescent lamps of the instant-start variety.

Another object of the present invention is to provide an electronic ballast for a fluorescent lighting system that includes power factor correction circuitry for maximizing power transfer efficiency from a 120 Vac/60 Hz standard power outlet.

Yet another object of the present invention is to provide an electronic ballast for a fluorescent lighting system that is adaptable to changing load requirements within the system and does not need to be substituted when lamps are removed, added, or replaced.

Still another object of the invention is to provide an electronic ballast for a fluorescent lighting system that incorporates an inverter circuit comprising two separate coils for respectively generating complete half-cycles of an oscillatory signal for powering one or more parallel-connected instant-start fluorescent lamps.

Yet still another object of the invention is to provide an electronic ballast for a fluorescent lighting system that is simple in design and highly efficient during all phases of lamp operation.

A specific object of the invention is to provide an electronic ballast for a lighting system having a capacity of anywhere from one to four 32 Watt instant-start fluorescent lamps.

In order to accomplish the foregoing objects of the invention, there is provided an electronic ballast for a fluorescent lighting system connected to a first alternating voltage source and containing two or more parallel-connected instant-start fluorescent lamps which present a load resistance to the alternating voltage source, the ballast comprising:

a converter circuit for receiving the first alternating source voltage and converting the first alternating source voltage to a direct current voltage relative to a reference voltage;

inverter circuit for receiving the direct current voltage and generating a second alternating voltage of magnitude sufficient to initiate a fluorescent process in each of the one or more parallel-connected instant start fluorescent lamps; and, a means for maintaining the second alternating voltage at a stable operating point when the load resistance presented by said one or more parallel-connected instant-start fluorescent lamps changes, the maintaining means including first means connecting the converted dc voltage to a first primary winding of a transformer for generating a first portion of said second alternating voltage at a predetermined frequency, and second means connecting a reference voltage to a second primary winding of the transformer for generating a second portion of the second alternating voltage, said transformer including a secondary winding for coupling said first and second portions in continuous succession to the one or more parallel-connected instant-start fluorescent lamps.

In this manner, when one of the two or more lamps either fails in operation, the circuit will still maintain constant, stable voltage across the remaining one or more lamps, in distinction to that heretofore known in the art.

BRIEF DESCRIPTION OF THE DRAWINGS

Reference may now be had to a preferred embodiment of the electronic ballast for a fluorescent lighting system constructed pursuant to the invention, taken in conjunction with the accompanying drawings; in which.

DETAILED DESCRIPTION

Figure 1:
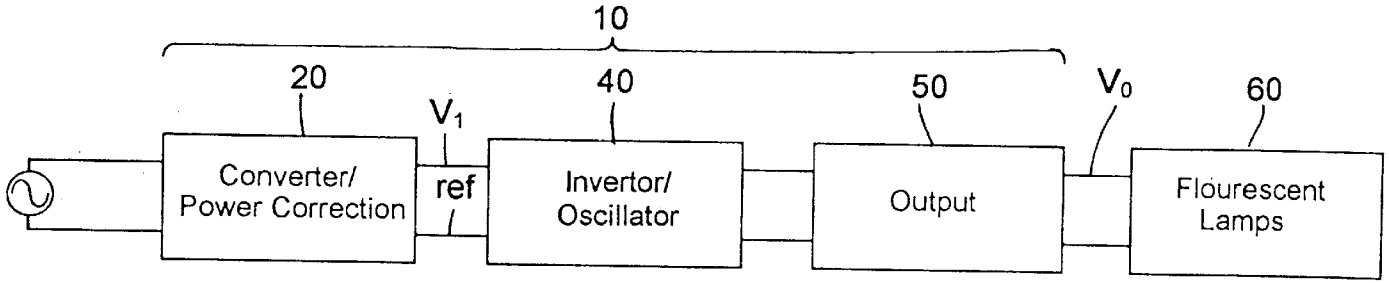
FIG. 1 is a schematic block diagram of the electronic ballast 10 for a fluorescent lighting system.

Referring now in more specific particularity to the drawings, as shown in FIG. 1, there is illustrated a block diagram representation of the electronic ballast 10 for use in a fluorescent lighting system 60. As is shown in FIG. 1, the electronic ballast 10 includes a power factor correction circuit 20 connected to an inverter/oscillator circuit 40 and output circuit 50 for coupling an output voltage $V_0$ to the flourescent lighting system 60 containing from one to as many as four fluorescent lamps indicated as fluorescent lamps 60*b*, . . . , 60*e* in FIG. 4. Preferably, each of the fluorescent lamps 60*b*–60*e* are of the instant-start type drawing anywhere from 32, 40, and up to 100 Watts during steady-state operation. The fluorescent lamps 60*b*–60*e* may be the usual phosphor coated tubular bulb with electrodes sealed into each end and containing a mercury-vapor at low pressure along with an inert starting gas such as argon. Although preferably filled with mercury vapor, the fluorescent lamps 60*b*–60*e* may also contain metal halide or sodium vapor depending upon the intended lighting application.

Figure 2:
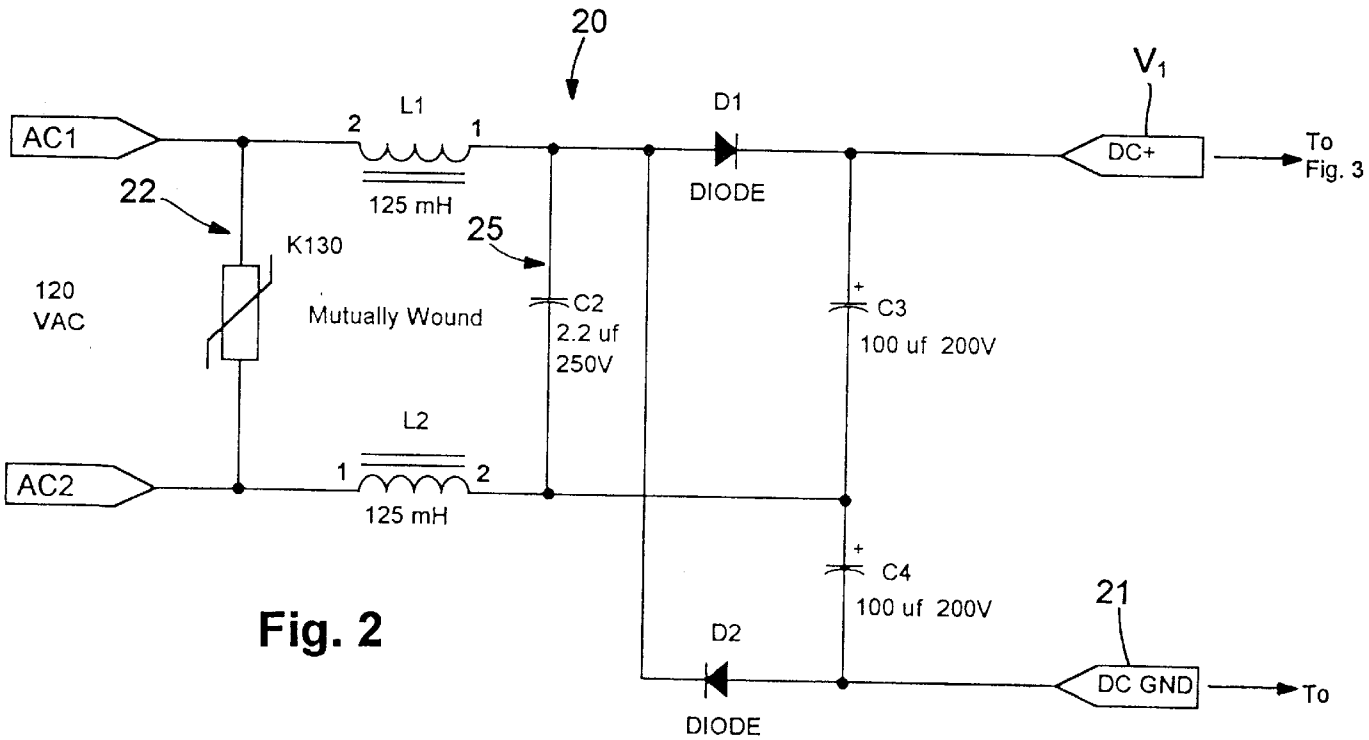
FIG. 2 is a schematic diagram of a preferred embodiment of the converter/power factor correction circuit 20.

FIG. 2 illustrates the preferred embodiment of the power factor correction circuit 20. The power factor correction circuit 20 includes a passive power factor correction circuit 22 comprising input chokes L1 and L2 and power factor correction capacitor C1 and is responsible for maintaining nearly unity power factor when changes in the load resistance presented by the lighting system 60 occur.

Although shown in FIG. 2 as integrally connected with the power passive factor correction circuit 22, a suitable ac-dc converter circuit 25 is provided to convert the alternating 120 Vac/60 Hz line voltage into a dc voltage indicated as $V_1$. Preferably, ac-dc converter circuit 25 includes a single-phase voltage multiplier circuit comprising rectifying diodes D1 and D2 and capacitors C3 and C4 that are each charged, during alternate half-cycles, to the peak value of the alternating input voltage, and capable of discharging in series to provide a dc voltage $V_1$ almost twice the value of the alternating current peak with reference a ground potential indicated as line 21.

Figure 3:
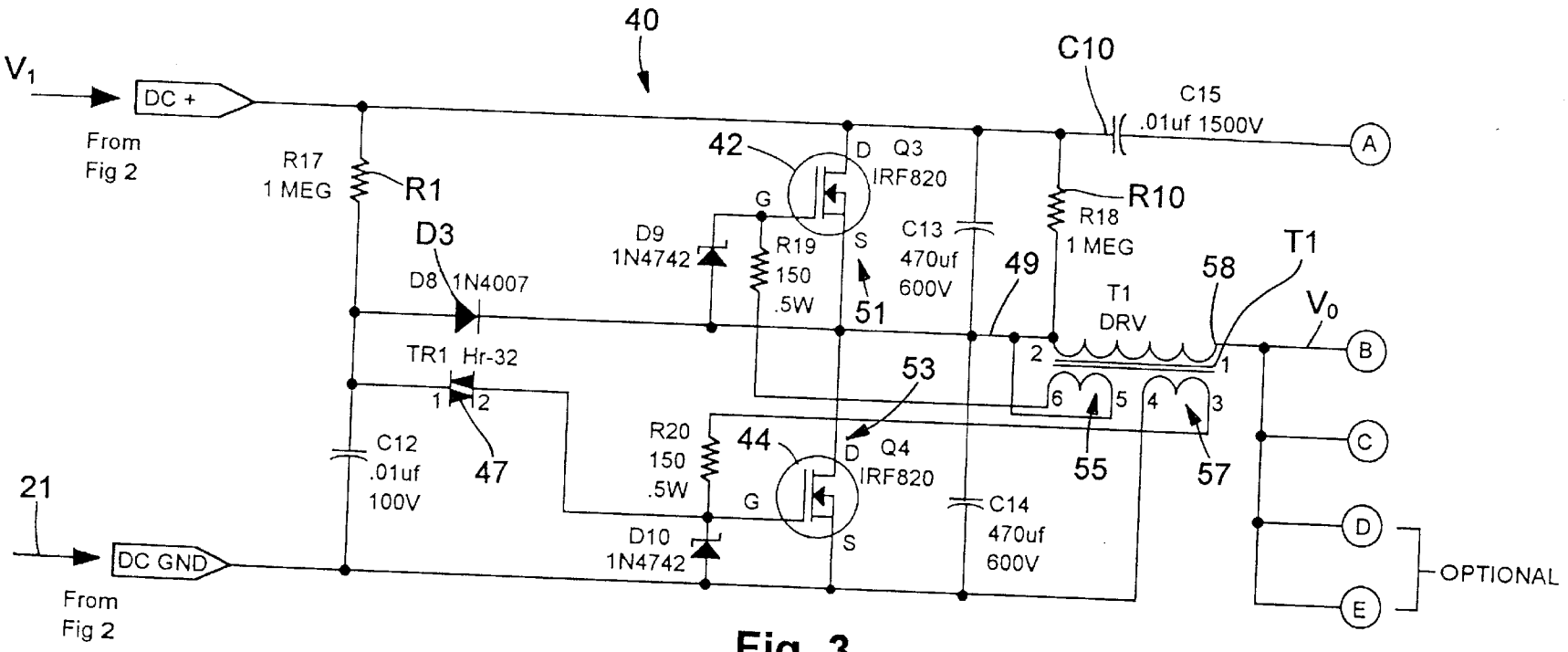
FIG. 3 is a schematic diagram of a preferred embodiment of the inverter/oscillator circuit 40 of the electronic ballast.

FIG. 3 illustrates the preferred embodiment of the oscillation circuit 40 for inverting the dc voltage $V_1$ at the output of the power factor correction circuit 20. As shown in FIG. 3, the ac-dc converter 25 output voltage $V_1$ is coupled through divider resistor $R_1$ to forward bias diode D3 and create a voltage on line 49 which connects terminal "2" of the primary winding of transformer T1 in sufficient magnitude to provide the initial strike voltage, indicated as voltage $V_0$, that is suitable for initiating a fluorescent process in each of the parallel-connected instant start fluorescent lamps 60*b*–60*e* generally indicated at points B, C, D and E. More specifically, when the fluorescent lighting system 60 is switched on by an external switch (not shown), the arc is created by the voltage $V_0$ present at the inputs. The instant start fluorescent lamps 60*b*, . . . , 60*d* typically require an initial arc striking voltage $V_0$ of at least 150–220 volts.

Figure 4:
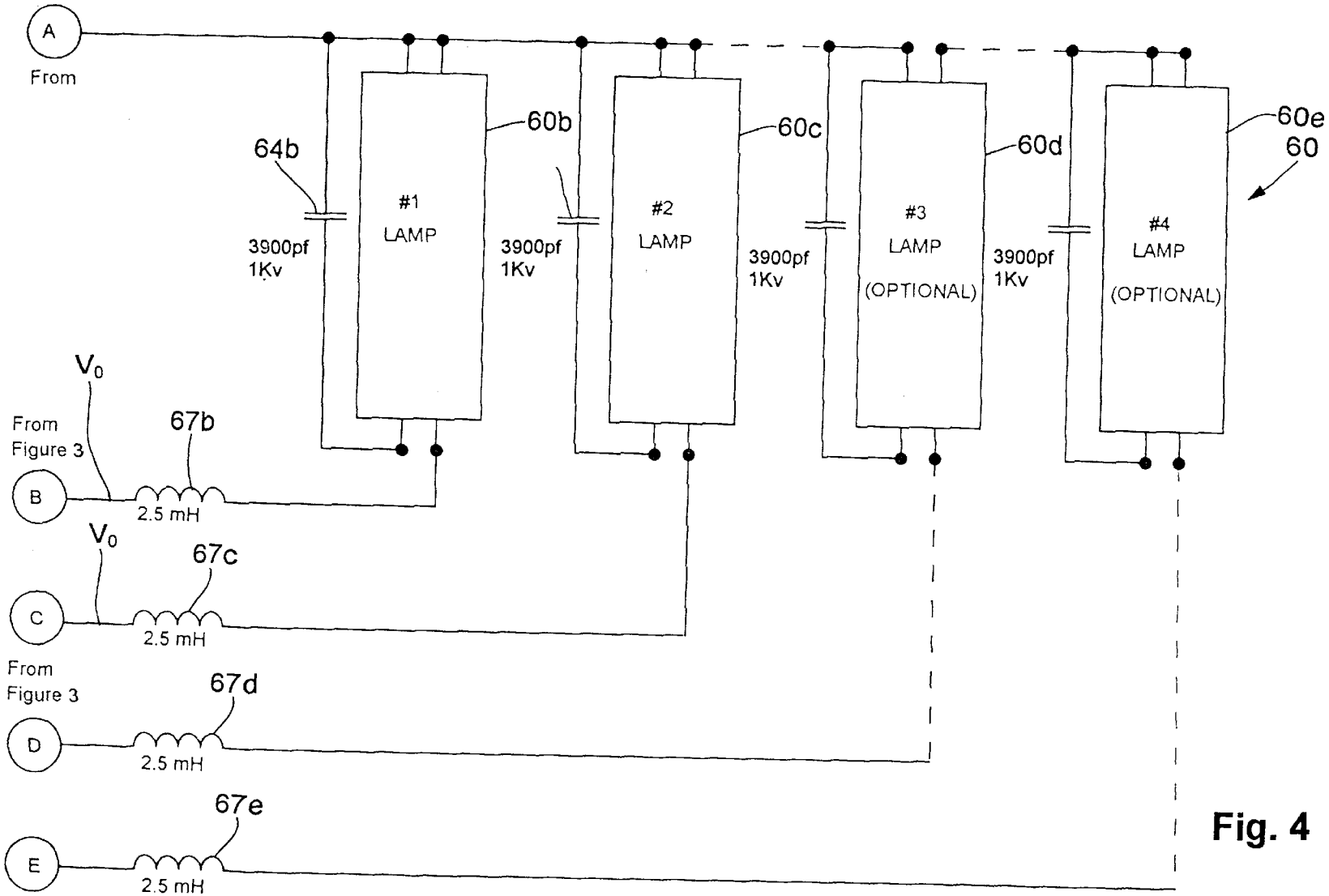
FIG. 4 is a circuit diagram of the output load consisting of one or more parallel-connected fluorescent lamps.

FIG. 4 shows voltage $V_0$ connected through current limiting coils 67*b* and 67*c* for initiating the arc discharge at the respective lamp terminals required to start the fluorescent process in each of the respective fluorescent lamps 60*b* and 60*c*. Without the necessity of changing the electronic ballast 10, lamps 60*d* and 60*e* may be optionally connected at points D and E, shown in broken line through respective current limiting coils 67*d* and 67*e* as illustrated in FIG. 4.

Referring back to FIG. 3, the voltage present on line 49 is present at a terminal "5" of coil 55 that comprises a portion of the secondary winding of the transformer T1. Coil 55 of the secondary winding connects with the gate of MOSFET 42 through biasing resistor R19 circuit 51 comprising the secondary winding 55 of transformer T1, MOSFET 42, capacitor C13, and Resistor R19 control one-half cycle of the resulting alternating signal $V_0$. Similarly, coil 57 comprising another portion of the secondary winding of transformer T1 connects with the gate of MOSFET 44 through biasing resistor R20. A circuit 53 comprising the winding 57 of transformer T1, MOSFET 44, capacitor C14, and Resistor R20 control the other one-half cycle of the resulting alternating signal $V_0$. MOSFETS 42 and 44 are configured as a push-pull type amplifier and while one MOSFET is turned off, the other one is turned on. The values of the circuit elements comprising circuits 51 and 53 determine the frequency of the alternating signal $V_0$ and, in the preferred embodiment, result in a 50 KHz alternating voltage signal. This signal is coupled through the output circuit 50 that comprises primary transformer winding 58 and input simultaneously to each of the fluorescent lamps 60*b*, . . . , 60*d* to maintain the stimulation of the gas and excitation of the phosphor coating in each of the fluorescent tubes thereof. The voltage of the alternating signal $V_0$ is much reduced as compared to the strike voltage component as is characteristic of instant-start type fluorescent lamps.

In view of FIG. 3, the operation of the inverter oscillator circuit 40 is as follows: the dc voltage present at $V_1$ is coupled through diodes D3 and zener D9 to effectively turn on MOSFET 42 and enable current conduction through the drain and source terminals thereof. The voltage rises at line 49 and consequently at coil 55 to thus provide a positive voltage excursion at transformer T1 which is output to the lamp system 60 as voltage $V_0$. As the voltage rises within coil 55, a voltage is induced within coil 57, through mutual induction, which acts to turn on MOSFET 44 through resistor R20. With MOSFET 44 turned on, current starts to conduct from its drain to source terminals effectively dissipating the energy stored in coil 55 and decreasing the voltage at line 49. As the voltage at line 49 decreases, MOSFET 42 is effectively turned off . As the energy stored in coil 55 decreases, an opposite voltage is induced in coil 57 of transformer T1 which provides an opposite voltage excursion at transformer T1 which is output to the lamp system 60 as voltage $V_0$. This increasing voltage at coil 57 acts to decrease the voltage at the gate input of MOSFET 42 which acts to turn off MOSFET 42. With MOSFET 42 in the off-state, voltage again increases at the gate of MOSFET 42 (line 49) thus turning it on. The process of alternately switching power MOSFET switches 42 and 44 on and off with the commensurate charging and discharging voltages at the coils 55 and 57, as described above, effectively provides a continuous alternating voltage through the primary winding of the transformer T1 at a frequency of 50 kHZ for output as voltage $V_0$ which is very stable and adapting to changing loads depending upon the fluorescent lighting system 60 at hand. It should be known to skilled artisans that different electronic component values may cause different operating frequencies.

Figure 5:
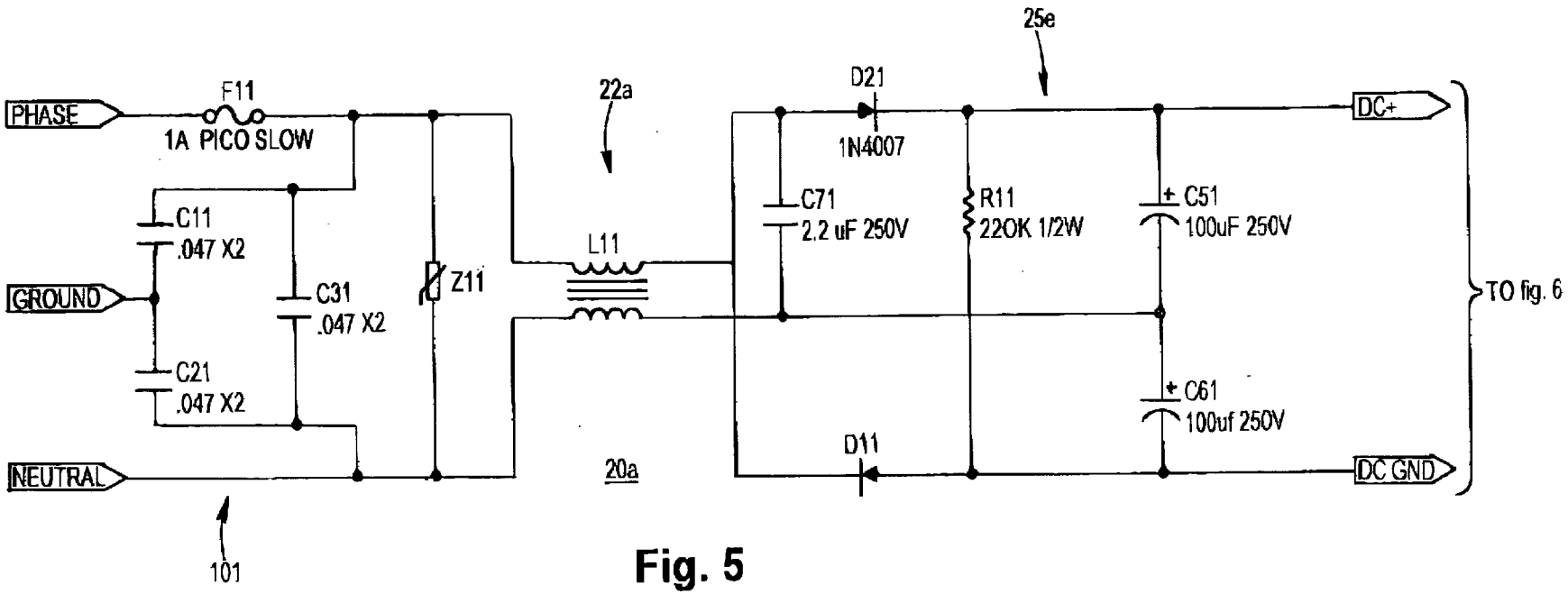
FIG. 5 is a schematic diagram of another preferred embodiment of a converter/power factor correction circuit 20*a*.

FIG. 5 illustrates another preferred embodiment of the power factor correction circuit 20*a* including a power factor correction circuit 22*a* and a converter circuit 25*a*. Here, the power factor correction circuit 20*a* is part of an input line filter 101 which filters out high frequency noise generated by the output section 50 of the ballast 10, as well as corrects the power factor for the AC input source. The primary components of the input line filter 101 are the capacitor C11 connected between the phase line of the AC input source and ground, the capacitor C21 connected between the neutral line of the AC input source and ground, the capacitor C31 connected between the phase line and the neutral line, a split series inductor L11 with inputs connected to the phase line and the neutral line, and a capacitor C71 placed across the outputs of the split series inductor L11.

As seen, the split series inductor L11 comprises a plurality of windings that form first and second inductor parts that are magnetically coupled to one another. The first part is in series with the phase line and has the 'dot' at the far side relative thereto (i.e., the output), and the second part is in series with the neutral line and has the 'dot' at the near side relative thereto (i.e., the input). As may be understood, L11 as a split series inductor provides a mechanism to correct for the power factor on the ballast 10, thereby being 'friendlier' to the AC input source. As one skilled in the art will appreciate, C11, C21, C31, L11, C71, D11, D21, C51 and C61 all combine to determine the power factor. Therefore, such components must be optimized in a known manner for any given load.

The converter circuit 25*a* shown in FIG. 5 is a voltage doubler similar to that shown in FIG. 2. As seen, diode D21 is connected in series between the output of the first part of the split series inductor L11 and the DC+ output, diode D11 is connected in series between the output of the first part of the split series inductor L11 and the DCGND output, capacitor C51 is connected between the DC+ output and the output of the second part of the split series inductor L11, capacitor C61 is connected between the DCGND output and the output of the second part of the split series inductor L11, and resistor R11 is connected between the DC+ output and the DCGND output.

Accordingly, during the positive half cycle of the AC input source, D21 is forward biased and capacitor C51 is charged to the peak positive value of the AC input source. Likewise, during the negative half cycle of the AC input source, D11 is forward biased and capacitor C61 is charged to the peak negative value of the AC input source. Therefore, the DC voltage across capacitors C51 and C61 in series (i.e., the voltage across the DC+ and DCGND outputs) is twice the peak value of the AC input source. As one skilled in the art will appreciate, the DC voltage produced by the voltage-doubling scheme shown in FIG. 5 is high enough to power the inverter/oscillator circuit 40*a* to be described below.

Figure 6:
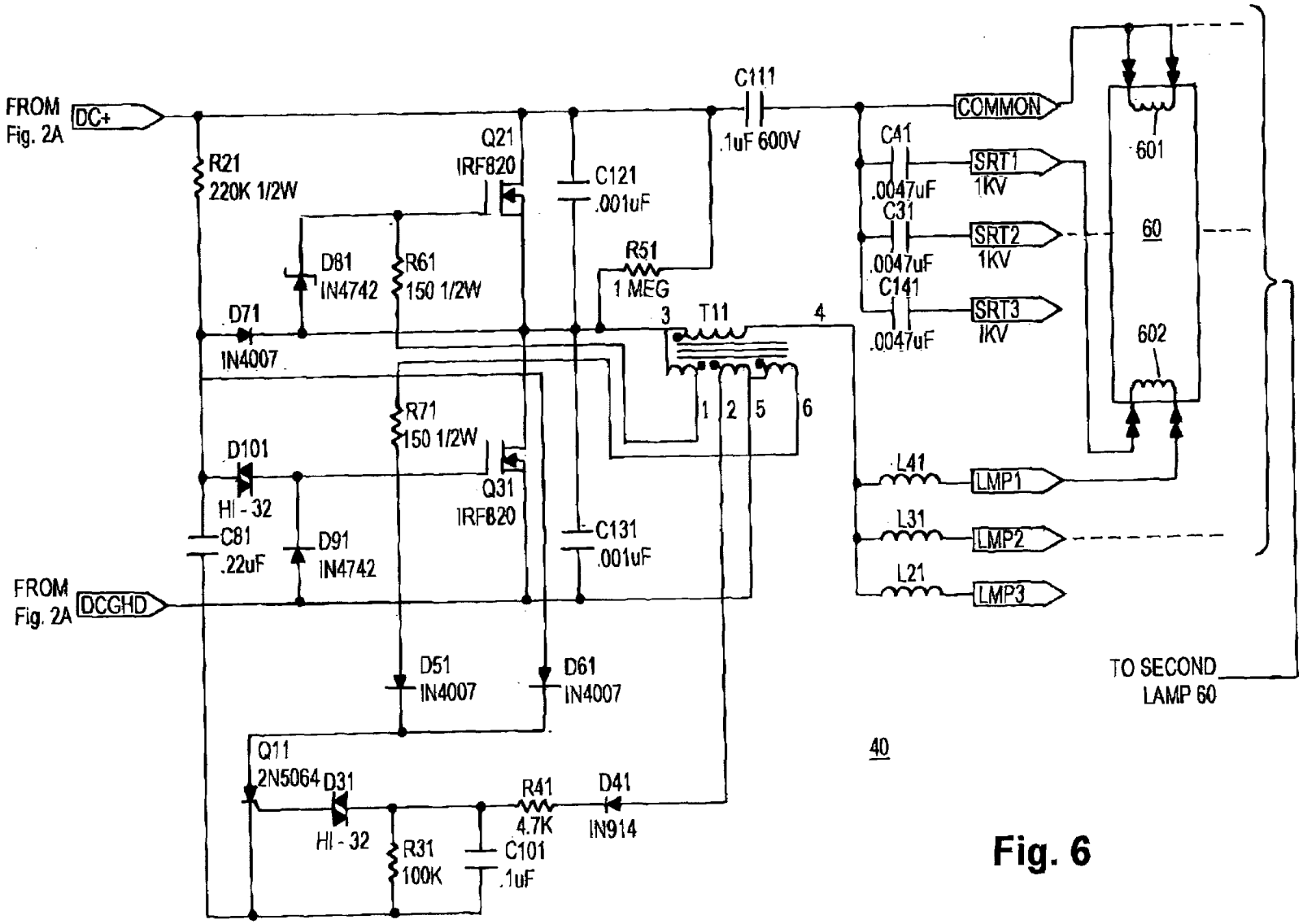
FIG. 6 is a schematic diagram of another preferred embodiment of the inverter/oscillator circuit 40 of the electronic ballast.

FIG. 6 illustrates another preferred embodiment of the oscillation circuit 40*a* as it is connected to one or more fluorescent lamps 60. As is known, such lamp 60 is operated by application of a relatively high frequency (tens of kilohertz) AC signal being applied across the elements 601, 602 within the lamp 60. Typically, and as is known, the elements 601, 602 are substantially identical, and one element 601 is a lighting element 601 and the other element 602 is a heating element 602. However, it is also known that the heating element 602 need not in fact be operated as a heater if the signal applied across the elements 601, 602 has a large-enough voltage (i.e., if the ballast 10 is an 'instant-start' ballast). Preferably, and as will be described below, the ballast 10 having the inverter circuit 40*a* is in fact an instant-start ballast and the heating element 602 is not operated for the purpose of being a heater.

As should be evident, the DC voltage produced by the inverter circuit 25*a* of FIG. 5 is applied to the DC+ and DCGND inputs of the circuit 40*a*. Accordingly, the capacitor C81 begins to charge through the resistor R21 to a threshold voltage determined by diac D101. When the aforementioned threshold voltage is reached, diac D101 conducts and turns on transistor Q31. Accordingly, capacitor C81 discharges through diode D71 and transistor Q31, thus preventing diac D101 from again reaching its threshold voltage.

In addition, when Q31 turns on, a forward current begins to flow from the DC+ input through capacitor C111, through capacitor C41 and through the lamp 60 (from the lighting element 601 to the heating element 602), through the inductor L41, through the primary coil of transformer T11, through transistor Q31, and then returns to the DCGND input. As seen, the transformer T11 has three secondaries: a 1–3 secondary, a 2–5 secondary, and a 5–6 secondary. Once the aforementioned forward current is established, reflected forward current in the 5–6 secondary of transformer T11 holds the transistor Q31 on by flowing from the 6 terminal through resistor R71 and then zener diode D91.

Transistor Q31 remains on until the current through the primary of transformer T11 reverses due to a series resonance developed by the inductor L41 and the series combination of capacitors C41 and C111. Specifically, such reverse current in the primary of the transformer T11 appears as a reflected reverse current in the 5–6 secondary of transformer T11, thus turning transistor Q31 off. As should be understood, a charge is developed on the capacitor C111 during this 'forward current' half cycle.

The reverse current in the primary of transformer T11 also produces a reflected reverse current in the 1–3 secondary of transformer T11, and such 1–3 secondary reverse current flows through resistor R61 and then through zener diode D81 to produce a voltage determined by such zener diode D81 at the gate of transistor Q21 such that transistor Q21 turns on. Once transistor Q21 is turned on, current runs from the DC+ input through transistor Q21, through the primary of transformer T11 (i.e., the reverse current continues), through inductor L41, through the lamp 60 (from the heating element 602 to the lighting element 601) and through the capacitor C41, and through the capacitor C111. Accordingly, the charge developed on the capacitor C111 during the forward current half cycle is discharged during the subsequent 'reverse current' half cycle.

As should now be understood, the reverse current through the primary of transformer T1 during the reverse current half cycle again reverses plurality due to a series resonance developed by inductor L41 and the series combination of capacitors C141 and C111, resulting in another forward current half cycle as was described above. The alternating forward and reverse current half cycles continues indefinitely to produce an AC current through the lamp 60 at a frequency determined (in a known manner) by the series resonant components C111, C41, and L41, and such AC current through such lamp 60 ("lighting current") causes the lamp 60 to light.

As was discussed above, the ballast 10 having the inverter circuit 40*a* as shown in FIG. 6 is operated as an instant-start ballast. Accordingly, the heating element 602 of the lamp 60 is not necessary. However, and preferably, the inverter circuit 40*a* employs the heating element 602 as a switching element. In particular, and as seen in FIG. 6, when the lamp 60 is connected to the inverter circuit 40*a* of the ballast 10, the switching element 602 is placed in series with the series resonant capacitor C41 and the series resonant inductor L41 such that the switching element 602 completes the series resonant circuit between the capacitor C41 and the inductor L41. As a result, if the lamp 60 is removed, the switching element 602 breaks the connection between the capacitor C41 and the inductor L41, thus resulting in an open circuit which prevents the series resonant circuit (C111, C41, L41) from operating and thereby stops the aforementioned resonance and plurality reversal.

If the lamp 60 were somehow connected to the ballast 10 such that only the switching element 602 made contact but the lighting element 601 did not, the connection between the capacitor C41 and the inductor L41 would be completed, but current would not flow through the lamp 60 (between the elements 601, 602). Accordingly, and absent any countermeasures, the inverter circuit 40*a* would run out of control until excessive currents through the series resonant circuit would result in the catastrophic failure of the ballast 10. Accordingly, and as a safety precaution, the 2–5 secondary of the transformer T11 monitors the voltage of the primary of transformer T11. If the voltage across the primary of transformer T11 becomes excessive, the reflected voltage in the 2–5 secondary likewise becomes excessive, thus generating a current through diode D41, through resistor R41, and then through resistor R31 and capacitor C101 to the DCGND input.

As should be understood, capacitor C101 charges until it reaches the threshold voltage of the diac D31, at which time such diac D31 conducts and turn SCR Q11 on. SCR Q11 then prevents the gate voltage of transistor Q3 from reaching a suitable level for Q3 to turn on by limiting the gate voltage to the forward voltage drops of the diode D51 and the SCR Q11. As a result, the oscillation of the inverter circuit 40A is interrupted and the ballast 10 is shut down. Turning SCR Q11 on also discharges the capacitor C81 through the diode D61 such that the ballast 10 is prevented from trying to restart the oscillation. Oscillation can be restarted only if the ballast 10 is turned off and on again, thereby interrupting the current running through the SCR Q11 and thus turning SCR Q11 off.

It should be understood that capacitor C121 acts as a snubber for transistor Q21, and capacitor C131 acts as a snubber for transistor Q31. Resistor R51 ensures that capacitor C111 is discharged when the ballast 10 is turned off.

As should be understood by one skilled in the art, and as shown in FIG. 6, additional lamps 60 may be attached to the inverter circuit 40*a* of the ballast 10 and be simultaneously operated thereby. Accordingly, capacitor C91 and inductor L31 can be combined to form a second series resonant circuit along with capacitor C111; capacitor C141 and inductor L21 can be combined to form a third series resonant circuit along with capacitor C111; etc.

Once again, one skilled in the art will appreciate that the various values of the afore-described components can and should be varied depending on desired output conditions. Accordingly, one skilled in the art will recognize that such use of such different electronic component values can vary without departing from the spirit and scope of the present invention.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A fluorescent lighting system connected to an alternating current (AC) voltage source providing a first AC voltage, the lighting system comprising:

a converter circuit connected to the AC voltage source for converting the first AC voltage to a direct current (DC) voltage and for supplying the DC voltage at an output;

an oscillator circuit having an input connected to the output of the converter circuit for receiving the DC voltage, the oscillator circuit for producing a second AC voltage from the DC voltage, the oscillator circuit including:

a series resonant circuit including a resonant capacitor and a resonant inductor in series;

a removable installed fluorescent lamp including first and second elements, the lamp being connected in parallel with the resonant capacitor of the series resonant circuit such that lighting current runs between the first and second elements, the second element being connected in series with the resonant capacitor and resonant inductor of the series resonant circuit and acting as a switching element; and a voltage monitoring circuit for monitoring the second AC voltage and for shutting down the oscillator if the second AC voltage exceeds a predetermined value, wherein with the fluorescent lamp installed in the system, the presence of the switching element completes a circuit between the resonant capacitor and resonant inductor of the series resonant circuit such that the oscillator circuit operates, and wherein with the fluorescent lamp removed from the system, the absence of the switching element creates an open circuit between the resonant capacitor and resonant inductor of the series resonant circuit such that the oscillator circuit ceases to operate.

2. The system of claim 1 wherein the series resonant circuit is a first series resonant circuit and the fluorescent lamp is a first fluorescent lamp, the oscillator circuit further comprising:

a second series resonant circuit including a resonant capacitor and a resonant inductor in series, the second series resonant circuit being connected in parallel with the first series resonant circuit; and a second removable installed fluorescent lamp including first and second elements, the second lamp being connected in parallel with the resonant capacitor of the second series resonant circuit such that lighting current runs between the first and second elements thereof, the second element of the second lamp being connected in series with the resonant capacitor and resonant inductor of the second series resonant circuit and acting as a switching element.

3. The system of claim 1 the converter circuit includes a power factor correction circuit for maintaining a near unity power factor.

4. The system of claim 3 wherein the power factor correction circuit comprises a split series inductor having a first part in series with a first line of the AC voltage source and a second part in series with a second line of the AC voltage source, and a power factor correction capacitor connected in series with and between the first part and the second part.

5. The system of claim 1 wherein the oscillator circuit further includes a transformer having a primary winding and first and second secondary windings, the series resonant circuit being connected to the primary winding of the transformer.

6. The system of claim 5 wherein the oscillator circuit further comprises:

a first voltage control circuit comprising a first transistor, a first biasing resistor connected between a gate of the first transistor and the first secondary winding, and a first capacitor connected between a source of the first transistor and a drain of the first transistor;

a second voltage control circuit comprising a second transistor, a second biasing resistor connected between a gate of the second transistor and the second secondary winding, and a second capacitor connected between a source of the second transistor and a drain of the second transistor, wherein the drain of the second transistor is connected to the source of the first transistor and wherein the first and second transistors are alternately turned on and off commensurate with charging and discharging of the first and second secondary windings, thereby providing a substantially continuous alternating voltage through the primary winding, the charging and discharging of the first and second secondary windings being governed at least in part by the series resonant circuit.

7. The system of claim 5 wherein the transformer further has a third secondary winding, the oscillator circuit further comprising an excessive primary winding voltage detection circuit coupled to the third secondary winding for determining a voltage of the primary winding and for shutting down the oscillation circuit if the voltage of the primary winding exceeds a predetermined level.

* * * * *